US007531731B2

(12) United States Patent
Longo et al.

(10) Patent No.: US 7,531,731 B2
(45) Date of Patent: May 12, 2009

(54) TREMOLO-LIMITER

(76) Inventors: Donald Longo, 1110 S. 3rd St., St. Charles, IL (US) 60174; David Bremer, 4921 N. Damen Ave., Chicago, IL (US) 60625

( * ) Notice: Subject to any disclaimer, the term of this patent is extended or adjusted under 35 U.S.C. 154(b) by 27 days.

(21) Appl. No.: 11/752,809

(22) Filed: May 23, 2007

(65) Prior Publication Data

US 2007/0295187 A1 Dec. 27, 2007

Related U.S. Application Data

(60) Provisional application No. 60/812,192, filed on Jun. 9, 2006.

(51) Int. Cl.
*G10D 3/00* (2006.01)

(52) U.S. Cl. ..... 84/313; 84/312 R

(58) Field of Classification Search ..... 84/312 R, 84/313

See application file for complete search history.

(56) References Cited

U.S. PATENT DOCUMENTS 4,572,049 A * 2/1986 Tanaka et al. ..... 84/313
4,882,967 A 11/1989 Rose
5,088,375 A 2/1992 Saijo
5,127,298 A 7/1992 Snape et al.
5,311,804 A 5/1994 Wilkinson
5,429,028 A 7/1995 Fisher, IV
5,431,079 A 7/1995 Bunker
5,539,143 A 7/1996 Rose
5,672,835 A * 9/1997 Doughty ..... 84/313
5,986,192 A 11/1999 Wingfield et al.
6,765,137 B2 7/2004 Smart
2004/0083875 A1 5/2004 Burton
2004/0255752 A1 12/2004 Geier

* cited by examiner

*Primary Examiner*—Kimberly R Lockett
(74) *Attorney, Agent, or Firm*—David J. Bremer

(57) ABSTRACT

The tremolo-limiting product ensures reliable and repeatable returns to the initial tuned position after tension-changing events. Some embodiments of the product can preserve string tuning while still providing limited tremolo use for musical effects. The product maintains tuning by obstructing the tremolo from pivoting past the initial tuned position when string tension is changed by string breakage and other events. The product can precisely and repeatably obstruct the tremolo at the initial tuned position so that string tuning is reliably preserved.

13 Claims, 5 Drawing Sheets

TREMOLO-LIMITER

The problem of maintaining tuning of a stringed instrument having a pivoting tremolo is well known among those knowledgeable in the art.

Tremolos are useful for modifying string pitch while playing the instrument, but string breakage and other events can result in de-tuning due to tremolo pivoting.

The tuned instrument relies on balance between collective string tension and at least one counterspring to return the pivoting tremolo to an initial tuned position after the tremolo is pivoted.

After string breakage and other tension-changing events, the collective string tension changes, and the pivoting tremolo seeks a new position where the new collective string tension balances the counterspring, resulting in string de-tuning.

The tremolo-limiting product ensures reliable and repeatable returns to the initial tuned position after tension-changing events. Some embodiments of the product can preserve string tuning while still providing limited tremolo use for musical effects.

The product maintains tuning by obstructing the tremolo from pivoting past the initial tuned position when string tension is changed by string breakage and other events. Even small changes to the tremolo position result in noticeable pitch variations, so the tuned position should be reproduced accurately. The product can precisely and repeatably obstruct the tremolo at the initial tuned position so that string tuning is reliably preserved.

The tremolo-limiting product limits tremolo pivoting by interposing a barricade between the tremolo and the instrument body. The barricade is pressed between the tremolo and the body when the tremolo pivots towards the body, obstructing the tremolo from pivoting past the barricade. This approach to limiting tremolo pivoting is found to be especially robust and reliable.

The product can selectively limit tremolo pivoting to only one direction and can limit the extent of tremolo pivoting in one direction. At least one embodiment of the product can selectively limit tremolo pivoting in both directions and can selectively limit the extent of pivoting in both directions.

The product is easily installable on various instruments and easily removable from various instruments. The product is re-usable after removing from an instrument and subsequently installable on a different instrument.

DRAWINGS

The product is used on a stringed instrument having an instrument body and a pivoting tremolo mounted to the body. The instrument has strings extending across the body and connecting to the tremolo. The body has a cavity extending into the body substantially perpendicularly away from the strings. The cavity has a cavity wall.

The instrument has a tremolo pivotally mounted to the instrument body. The tremolo has a tremolo block extending into the cavity. The strings connect to the tremolo, and a counter spring connects to the tremolo block distal the strings. The tremolo pivots about a pivot axis between the strings and the counterspring so that the strings and the counterspring bias the tremolo to pivot in opposite directions, respectively. There can be more than one counterspring.

The tremolo-limiting product has barricade. The barricade is positioned between the tremolo block and the cavity wall, and between the strings and the counterspring.

The barricade extends towards the tremolo block and the cavity wall, and is adjustable between a contracted state and an expanded state. The barricade in the expanded state extends further towards the tremolo block and the cavity wall than the barricade in the contracted state.

When the tremolo pivots so that the tremolo block moves towards the cavity wall, the barricade is pressed between the tremolo block and the cavity wall and obstructs the tremolo from pivoting further towards the cavity wall.

By adjusting the barricade between the contracted state and the expanded state, a user can control how far the tremolo block can pivot towards the cavity wall. When the barricade is in the contracted state, the tremolo block can pivot further towards the cavity wall than the tremolo block can pivot when the barricade is in the expanded state.

The barricade can be adjusted so that the barricade contacts both the tremolo block and the cavity wall. It is useful to adjust the barricade as such when the instrument is tuned, so that the barricade contacts both the cavity wall and the tremolo block when the tremolo is in the tuned position. When adjusted as such, the tremolo is obstructed from moving towards the cavity wall beyond the tuned position.

Alternatively, the instrument can be tuned after similarly adjusting the barricade, thereby establishing the tuned position with the barricade contacting the block and the wall.

The barricade can have a first barricade component and a second barricade component.

The first barricade component and the second barricade component can be positioned, with respect to each other, to adjust the barricade between the contracted state and the expanded state.

Figure 1:
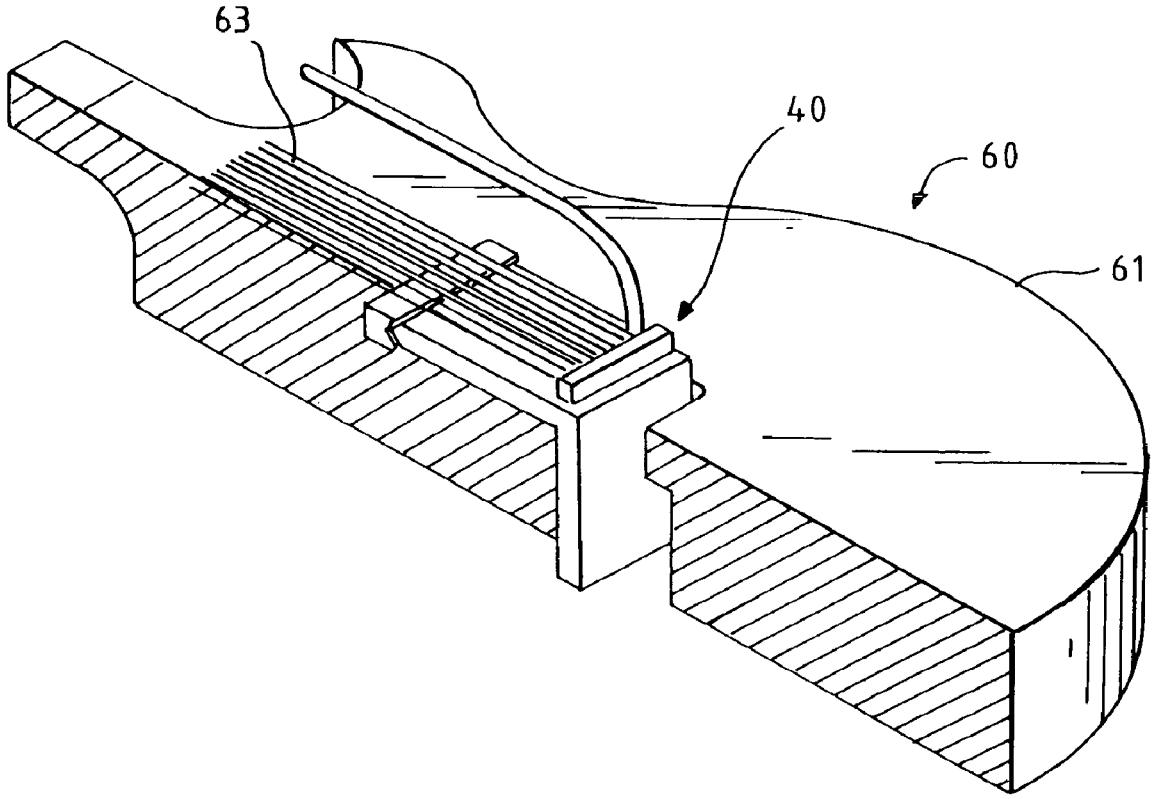
FIG. 1 is a perspective partial view of an instrument with an embodiment of the product attached.

The guitar 60 shown in FIG. 1 has a body 61 and strings extending across the body, such as the string 63. The body 61 has a cavity extending away from the strings and the cavity has a cavity wall 64.

The guitar 60 has a tremolo 40 pivotally mounted to the body and pivoting about a pivot axis 62. The tremolo 40 has a tremolo block 41 extending into the cavity and substantially opposite the cavity wall 64.

The tremolo 40 connects to strings, such as the string 63, and connects to at least one counterspring, such as the counterspring 42. The string 63 and the counterspring 42 are connected to the tremolo with the pivot axis 62 between the string 63 and counterspring 42.

When the strings are tensioned, they bias the tremolo 40 to pivot so that the tremolo block 41 moves away from the cavity wall 64. As the tremolo pivots, the counterspring 42 extends and biases the tremolo to pivot so that the tremolo block 41 moves towards the cavity wall 64. The tremolo pivots until the action of the strings on the tremolo is balanced by the action of the counterspring on the tremolo.

The product can be installed on the instrument in various ways, so long as the barricade is positioned between the tremolo block and the cavity wall.

Figure 2:
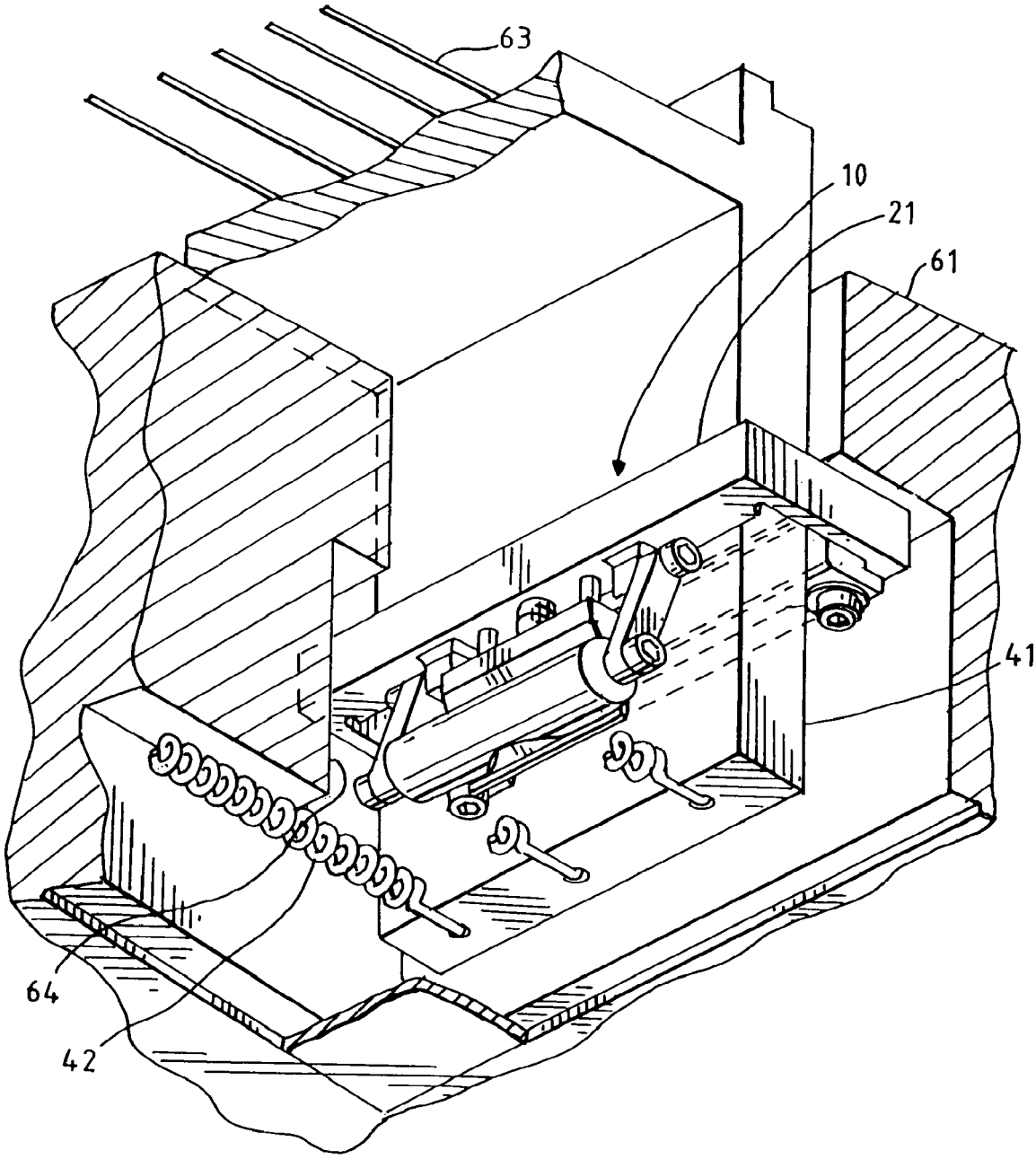
FIG. 2 is a perspective cutaway view of an embodiment of the product attached to an instrument.

For example, as shown in FIG. 2, the product 10 is fixed to and moves with the tremolo. The product 10 has a frame 21 having a first surface 23 and a second surface 24 spaced apart from the first surface 23. The surfaces are substantially opposite each other.

The frame 21 is positioned so that the tremolo block 41 is between the first and second surface.

The product 10 has an adjustable clamp 22. In use, at least part of the clamp 22 is positioned between the first and second surfaces.

By adjusting the clamp 22 via the clamping screws, for example, the clamping screw 80, the clamp can be moved across the second surface 24 so that the tremolo block 41 is clamped between the clamp and the first surface 23 and whereby the product is fixed to and moves with the tremolo block.

Figure 3:
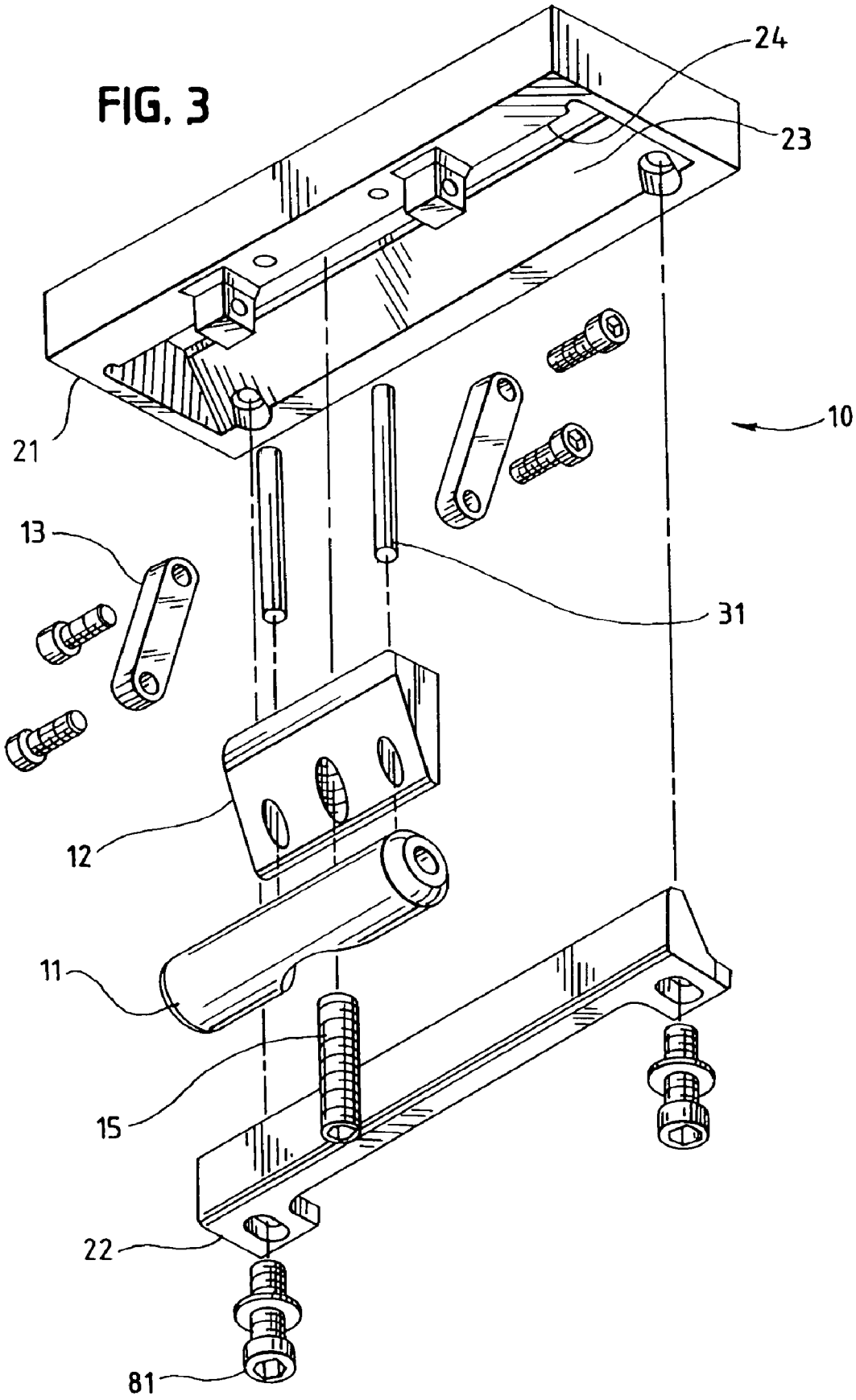
FIG. 3 is an exploded perspective view of an embodiment of the product.
Figure 4:
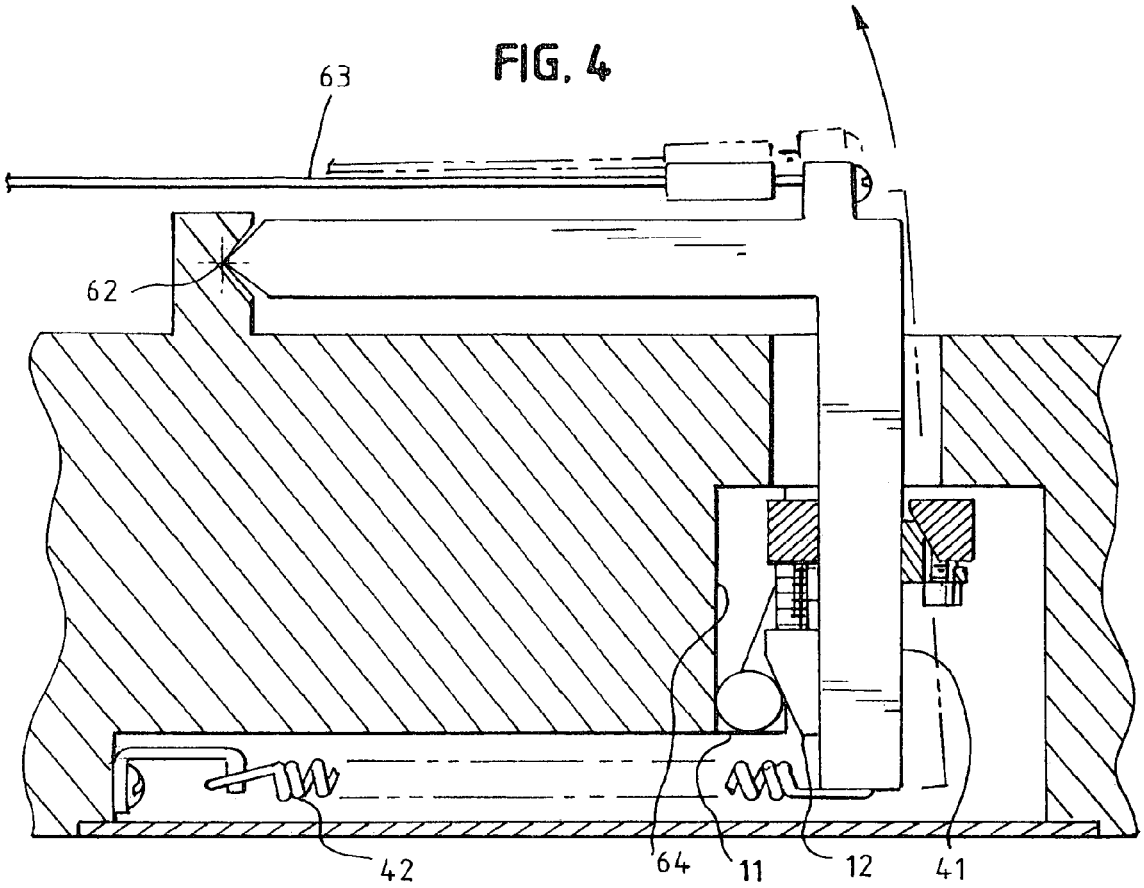
FIG. 4 is a side section view of an embodiment of the product attached to an instrument.

As shown in FIG. 3, the product 10 comprises a first barricade component 11 and a second barricade component 12. The first barricade component 11 and the second barricade component 12 are positioned between the tremolo block 41 and the cavity wall 64 as well as between the string 63 and the counterspring 42.

The first barricade component 11 is connected to an arm 13. The first barricade component 11, with the arm 13, rotates between the tremolo block 41 and the cavity wall 64. The first barricade component 11 is substantially circularly cylindrical.

The second barricade component 12 moves linearly along a guide 31. The second barricade component 12 is substantially wedge-shaped.

By changing the position of the first barricade component 11 with respect to the second barricade component 12 the barricade is adjusted between the contracted state and the expanded state.

The first barricade component 11 and the second barricade component 12 can be positioned, with respect to each other, by moving the second barricade component 12 along the guide 31, with the first barricade component 11 contacting the second barricade component 12. As the component 12 moves linearly along the guide 31, the component 11 variably extends outwards from the component 12, depending on the linear position of component 12.

Figure 5:
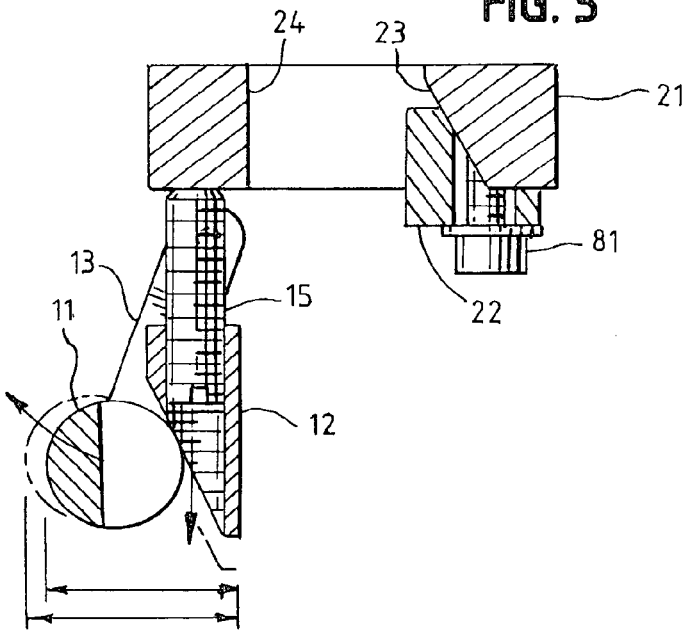
FIG. 5 is a side section view of an embodiment of the product.

FIG. 5 shows the barricade in the contracted state (solid lines) and in the expanded state (dashed lines.) The first barricade component and the second barricade component extend outwards further in the expanded state than in the contracted state. When the barricade is pressed between the tremolo block and the cavity wall, the tremolo block will pivot further towards the cavity wall with the barricade in the contracted state than with the barricade in the expanded state.

The first barricade component and the second barricade component can have various shapes and various configurations.

For example, the first barricade component can move linearly between the block and the wall.

Alternatively, the first barricade component can move curvilinearly, step-wise, and in various other movements and combinations thereof. The first barricade component can be rectangular, pyramidal, wedge-shaped, cone-shaped, curvilinear, and various other shapes and combinations thereof.

The second barricade component can move curvilinearly, step-wise, and in various other movements and combinations thereof. The second barricade component can be pyramidal, cone-shaped, curvilinear, rectangular, and various other shapes and combinations thereof.

The second barricade component can be fixed in position and the first barricade component can move with respect to the second barricade component. Alternatively, the first barricade component can be fixed in position and the second barricade component can move with respect to the first barricade component.

The first barricade component and the second barricade component can have various other shapes and various other configurations, so long as they meet the functional requirements adjusting the barricade between the contracted state and the expanded state.

The product can be attached to the instrument in various ways.

For example, in FIG. 2, the product 10 is fixed to and moves with the tremolo block.

Figure 6:
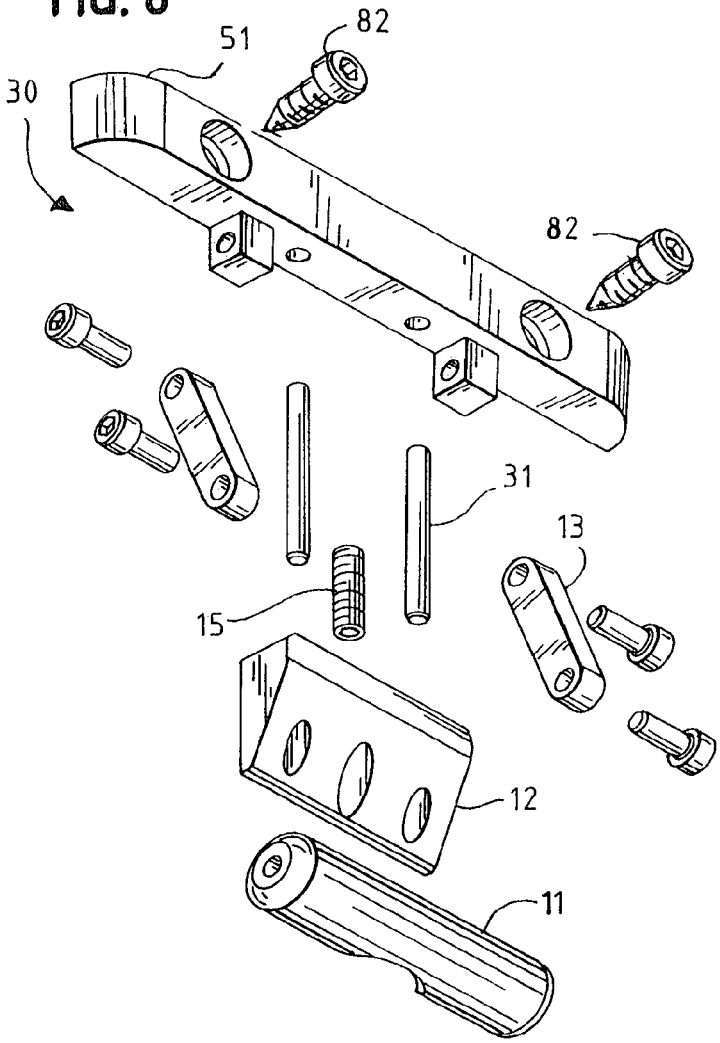
FIG. 6 is a side section view of an embodiment of the product attached to an instrument.

Alternatively, in FIG. 6, the product 30 is fixed to and moves with the instrument body.

Figure 7:
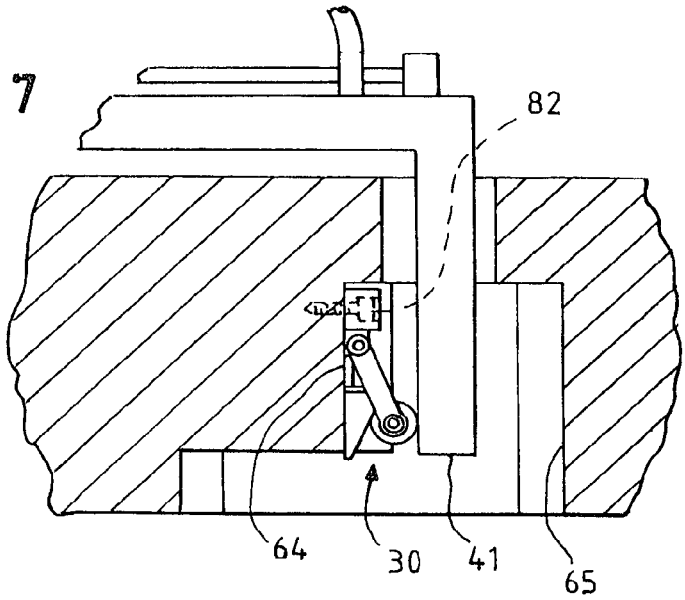
FIG. 7 is an exploded perspective view of an embodiment of the product.

As seen in FIG. 7 the product 30 comprises a wall mount 51 that can be fixed to the cavity wall 64 via fasteners, such as the mount fastener 82. The product 30 comprises the first barricade component 11 and the second barricade component 12 that are positioned between the cavity wall 64 and the tremolo block 41.

The product can be installed on the instrument so that the barricade is between the tremolo block and another cavity wall, for example the cavity wall 65. When installed as such, the product can obstruct the tremolo block from pivoting towards the cavity wall 65.

Both the product 10 and the product 30 can be attached so that the barricade is 10 between the tremolo block 41 and the cavity wall 65 and thereby obstructs the tremolo block 41 from pivoting towards the cavity wall 65.

The product can be installed at various distances from the strings. For example, the product 10 can be fixed to the tremolo block 41 at various points along the tremolo block.

The product can be installed on the instrument in various ways so long as barricade can be positioned between the tremolo block and the cavity wall.

What is claimed is:

1. A tremolo-limiting product for use with a stringed instrument, the instrument comprising a body and a tremolo, the body having a tremolo cavity with a tremolo cavity wall, the tremolo having a tremolo block extending into the cavity, the tremolo being pivotally mounted to the instrument between a string and a counterspring, the product comprising:

a barricade in use being positioned between the tremolo block and the cavity wall and between the string and the counterspring;

the barricade in use being pressed between the tremolo block and the cavity wall when the tremolo block pivots towards the cavity wall;

the barricade being progressively adjustable between a contracted state and an expanded state; and the barricade in the expanded state obstructing the tremolo block further from the cavity wall than the barricade in the contracted state.

2. The product of claim 1 wherein the barricade comprises:

a first barricade component and a second barricade component;

the first barricade component and the second barricade component being positionable, with respect to each other, to progressively adjust the barricade between the contracted state and the expanded state.

3. A tremolo-limiting product for use with a stringed instrument, the instrument comprising a body and a tremolo, the body having a tremolo cavity with a tremolo cavity wall, the tremolo having a tremolo block extending into the cavity, the tremolo being pivotally mounted to the instrument between a string and a counterspring, the product comprising:

a barricade in use being positioned between the tremolo block and the cavity wall and between the string and the counterspring;

the barricade in use being pressed between the tremolo block and the cavity wall when the tremolo block pivots towards the cavity wall;

the barricade being progressively adjustable between a contracted state and an expanded state; and the barricade in the expanded state obstructing the tremolo block further from the cavity wall than the barricade in the contracted state; and wherein the product is fixed to and moves with the tremolo block.

4. The product of claim 1 wherein the product is fixed to and moves with the instrument body.

5. The product of claim 2 wherein the product is fixed to and moves with the tremolo block.

6. The product of claim 2 wherein the product is fixed to and moves with the instrument body.

7. The product of claim 2 wherein the first barricade component is substantially wedge-shaped.

8. The product of claim 3 further comprising:

a frame securing the product to the tremolo block, the frame comprising:

at least two opposite, spaced-apart surfaces;

an adjustable clamp;

at least part of the clamp being positioned between the spaced-apart surfaces;

the clamp being movable to adjust the distance between the clamp and the spaced-apart surfaces; and the frame clamping the tremolo block securely between the clamp and the spaced-apart surfaces.

9. The product of claim 8 wherein the barricade further comprises:

a first barricade component and a second barricade component; and the first barricade component and the second barricade component being positionable with respect to each other, to progressively adjust the barricade between the contracted state and the expanded state.

10. A stringed instrument, the instrument comprising:

an instrument body having a tremolo cavity with a tremolo cavity wall;

a tremolo pivotally mounted to the instrument between a string and a counterspring;

the tremolo having a tremolo block extending into the cavity;

a tremolo-limiting product comprising:

a barricade in use being positioned between the tremolo block and the cavity wall and between the string and the counterspring;

the barricade in use being pressed between the tremolo block and the cavity wall when the tremolo pivots towards the cavity wall;

the barricade being progressively adjustable between a contracted state and an expanded state; and the barricade in the expanded state obstructing the tremolo block further from the cavity wall than the barricade in the contracted state.

11. The stringed instrument of claim 10 wherein the tremolo-limiting product is fixed to and moves with the tremolo block.

12. The stringed instrument of claim 10 wherein the tremolo-limiting product is fixed to and moves with the instrument body.

13. The stringed instrument of claim 10 wherein the tremolo-limiting product further comprises:

a frame securing the product to the tremolo block so that the product moves as one with the tremolo block;

the frame comprising:

at least two opposite, spaced-apart surfaces;

an adjustable clamp, at least part of the clamp being positioned between the spaced-apart surfaces;

the clamp being movable to adjust the distance between the clamp and the spaced-apart surfaces;

the frame clamping the tremolo block securely between the clamp and the spaced-apart surfaces;

and wherein the barricade further comprises:

a first barricade component and a second barricade component; and the first barricade component and the second barricade component being positionable, with respect to each other, to progressively adjust the barricade between the contracted state and the expanded state.

* * * * *